US006009297A

United States Patent [19]

Maeda et al.

[11] Patent Number: 6,009,297

[45] Date of Patent: Dec. 28, 1999

[54] INTERMEDIATE TRANSFER MEMBER AND IMAGE-FORMING DEVICE

[75] Inventors: Yuko Maeda, Hino; Norihiko Kaga; Chikara Yamada, both of Kodaira; Yoshitomo Masuda, Hamura; Takahiro Kawagoe, Tokorozawa, all of Japan

[73] Assignee: Bridgestone Corporation, Tokyo, Japan

[21] Appl. No.: 09/291,201

[22] Filed: Apr. 14, 1999

[30] Foreign Application Priority Data

Jun. 26, 1998 [JP] Japan ..... 10-180818

[51] Int. Cl.[6] ..... G03G 15/01; G03G 15/16

[52] U.S. Cl. ..... 399/302; 430/126

[58] Field of Search ..... 399/302, 308, 399/297; 430/126; 428/64.1, 64.2, 425.8

[56] References Cited

U.S. PATENT DOCUMENTS 5,689,787 11/1997 Tombs et al. ..... 399/308

5,715,510 2/1998 Kusaba et al. ..... 399/308

FOREIGN PATENT DOCUMENTS 8-146705 6/1996 Japan .

*Primary Examiner*—Susan S. Y. Lee

*Attorney, Agent, or Firm*—Sughrue, Mion, Zinn, Macpeak & Seas, PLLC

[57] ABSTRACT

A new intermediate transfer member which has a durable coating layer which easily conforms to the elastic deformation of the rubber layer, exhibits good wear resistance, permits easy resistance control, and fulfills such requirements as protection of the photosensitive body from staining, prevention of toner sticking, and decrease in the coefficient of friction. It is characterized in that the coating layer is composed mainly of a urethane resin which is formed from a polyol compound and a polyisocyanate compound in an excess amount in terms of NCO/OH molar ratio and which contains a solvent-insoluble fraction no less than 70%.

12 Claims, 4 Drawing Sheets

INTERMEDIATE TRANSFER MEMBER AND IMAGE-FORMING DEVICE

BACKGROUND OF THE INVENTION

The present invention relates to an improvement on the intermediate transfer member that is used in the electrostatic recording process for electrophotographic devices and electrostatic recording devices such as copying machines and printers in which an electrostatic latent image is formed on the surface of an image-forming body, the latent image is developed with a toner, and the toner image is transferred to a recording medium such as paper via said intermediate transfer member which holds the toner image temporarily before image transfer. The present invention relates also to an improvement on the image-forming device which forms images by the intermediate transfer system using said intermediate transfer member.

Conventional electrophotographic image-forming devices such as copying machines and printers work in the following manner. First, a photosensitive body (image-forming body) has its surface uniformly charged by a charging means such as charging roll. The charged photosensitive body is given a projected image through an optical system, so that the part struck by light becomes discharged, thereby forming an electrostatic latent image. The photosensitive body is given a toner by the aid of a developing roll or any other developing means, so that the latent image electrostatically attracts the toner, thereby forming a toner image. The toner image is transferred to a recording medium such as paper by a transfer means such as a transfer roll. The transferred image is fixed with heating to the recording medium by the aid of a fixing means such as a fixing roll. In this way a print image is obtained.

The above-mentioned process is basically applied also to color printers and color copying machines; however, it needs some modifications for color images which are formed by four toners, that is, magenta, yellow, cyan, and black. In order to obtain a desired hue, a process is necessary to overlay these toners in a certain ratio. There have been proposed several systems to achieve this object.

The first system is the multiple development system, in which the electrostatic latent image on the photosensitive body is developed (made visible) by sequentially overlaying the four toners, magenta, yellow, cyan, and black so that a color toner image is formed on the photosensitive body as in the case of monochromatic printing. This system permits the device to be constructed comparatively compact but has the disadvantage of having difficulties in tone control and being unable to produce high-quality images.

The second system is the tandem system, in which four photosensitive bodies are arranged in tandem and latent images on them are developed with four toners (magenta, yellow, cyan, and black) respectively. The resulting toner images are transferred sequentially to a recording medium such as paper so as to reproduce a color image thereon. This system gives rise to images of good quality but has the disadvantage of requiring a large, expensive device because each photosensitive body has a charging mechanism and a developing mechanism.

The third system is the transfer drum system, in which a recording medium such as paper is wound around a transfer drum which is turned four times such that the four magenta, yellow, cyan, and black toner images on the photosensitive body are sequentially transferred to the recording medium so as to reproduce a color image. This system produces images of comparatively good quality but has the disadvantage of involving difficulties in winding a thick paper such as post card around the transfer drum. This restricts the kind of recording medium to be used.

In order to eliminate the above-mentioned disadvantages of the multiple development system, the tandem system, and the transfer drum system, there has been proposed a new system called the intermediate transfer system. This system does not need a large device, nor does it restrict the kind of recording medium to be used.

The intermediate transfer system is designed such that the toner images of magenta, yellow, cyan, and black on the photosensitive body are sequentially transferred to and held temporarily by an intermediate transfer member in the form of drum or belt so that a color image is formed on the intermediate transfer member, and this color image is finally transferred to a recording medium such as paper. This system has the advantage of producing a high-quality image because of its ability to control the tone by overlaying four toner images. This system does not need a large device because it obviates photosensitive bodies arranged in tandem as in the tandem system, nor does it restrict the kind of recording medium to be used because it obviates the necessity of winding the recording medium around the transfer drum as in the transfer drum system.

The color image formation by the intermediate transfer system may be accomplished by a device shown in FIG. 1 (which employs a cylindrical intermediate transfer member) or by a device shown in FIG. 2 (which employs a belt-like intermediate transfer member).

Referring to FIGS. 1 and 2, there is shown a cylindrical photosensitive body 1 which rotates in the direction of the arrow indicated. This photosensitive body 1 is charged by the primary charger 2. Upon exposure to the image light 3, the exposed part loses the charge and hence forms on the photosensitive body 1 an electrostatic latent image corresponding to the first color component. The electrostatic latent image is developed with the first color (magenta toner M) by the developer 41. There is formed on the photosensitive body 1 an image of the first color (magenta toner). This toner image is transferred to the intermediate transfer drum 20*a* (in FIG. 1) or the intermediate transfer belt 20*b* (in FIG. 2) which turns in contact with the photosensitive body 1. (The drum and belt are collectively referred to as "intermediate transfer member 20*a* or 20*b*" hereinafter.) The transfer from the photosensitive body 1 to the intermediate transfer member 20*a* or 20*b* takes place at the nip between them because the latter is biased by the power source 61. After the transfer of the first toner (magenta) image to the intermediate transfer member 20*a* or 20*b*, the photosensitive body 1 has its surface cleaned by the cleaning unit 14. This cycle completes the development and transfer operation as the photosensitive body 1 makes one turn. Subsequently, the photosensitive body 1 turns three times and the toner images of the second color (cyan), the third color (yellow), and the fourth color (black) are formed consecutively on the photosensitive body 1 by the developing units 42, 43, and 44. After each turn, each toner image is transferred to the intermediate transfer member 20*a* or 20*b* and overlaid on the previously transferred image. Thus a synthesized color toner image corresponding to the original color image is formed on the intermediate transfer member 20*a* or 20*b*. Incidentally, the device shown in FIG. 2 has a developing station which holds developers 41 to 44 which are displaced sequentially each time the photosensitive body 1 turns so that development takes place sequentially with magenta toner (M), cyan toner (C), yellow toner (Y), and black toner (B).

With an image of overlaid color toners formed thereon, the intermediate transfer member 20*a* or 20*b* comes into contact with the transfer roller 25, and the nip between them receives a recording medium 24 (such as paper) from the paper feed cassette 9. At the same time, a secondary transfer bias is applied to the transfer roller 25 from the power source 29, so that the synthesized color toner image is transferred from the intermediate transfer member 20*a* or 20*b* to the recording medium 24. The recording medium 24 is further led to the fixing station 15 in which the synthesized color toner image is fixed by heating on the recording medium 24. After transfer, the intermediate transfer member 20*a* or 20*b* has its surface cleaned of residual toner by the cleaning unit 35 and returns to the initial state and becomes ready for the next cycle of image forming.

For images to be formed by the intermediate transfer system, the above-mentioned intermediate transfer member 20*a* or 20*b* should be made of a soft, resilient material because it comes into direct contact with the photosensitive body 1, the toner image, and the recording medium 24. A cylindrical intermediate transfer member 20*a* as shown in FIG. 1 is made up of a metal drum base (or cylindrical metal core) 200 and a surface layer of electrically conductive rubbery elastic material 201 as shown in FIG. 3. A belt-like intermediate transfer member 20*b* as shown in FIG. 2 is a belt formed from an electrically conductive rubbery elastic material 201 reinforced with fabrics or spirally wound yarns (not shown) as shown in FIG. 4. The rubbery elastic material 201 may have on its surface a resin coating layer 202 to protect the photosensitive body from being stained, to prevent the toner from sticking to it, and to decrease the coefficient of friction.

When used for an electrophotographic image-forming device, the intermediate transfer member shown in FIGS. 1 and 2 greatly affects the transfer efficiency and hence the image forming depending on its resistivity. It is desirable that the intermediate transfer member have a resistivity in the so-called middle range of $10^{11}$ to $10^{14}$ Ω·cm. This presents difficulties in making the intermediate transfer member free from variation in resistance. It is particularly difficult to adjust a rubber compound to such a middle range of resistivity. An idea proposed so far to address this problem is that the layer of rubbery elastic body 201 is adjusted to a resistivity of $10^{3}$ to $10^{6}$ Ω·cm, which is comparatively easy to attain, and this layer is covered with a coating layer 202 of resin having a comparatively high resistivity, so that the intermediate transfer member as a whole has a desired resistivity in the middle range as mentioned above.

The disadvantage of this layer structure is that the resin coating layer 202 is generally much harder than the rubbery elastic body and hence it does not fully conform to the elastic deformation of the electrically conductive rubber layer 201. The result is that the coating layer 202 formed on the intermediate transfer drum 20*a* or the intermediate transfer belt 20*b* tends to crack. The cracking causes rubber compounding ingredients to ooze out, catches toner particles, or changes the coefficient of friction. These troubles defeat the desired object. The durability of the coating layer is important particularly for the belt-like intermediate transfer member which undergoes extreme flexing.

A conceivable solution to this problem is to make the coating layer 202 from a soft resin; however, this is not practical because a soft resin is subject to large plastic deformation and is sticky with a high coefficient of friction.

When the coating layer 202 is to function to adjust the resistivity of the intermediate transfer member as a whole, it has to be incorporated with an electrically conducting material such as carbon black for decrease in resistivity because a resinous material in general has a high volume resistivity. This leads to the necessity of complex processes, including preparation of a coating material and formation of a coating layer, both containing an electrically conducting material uniformly dispersed therein.

SUMMARY OF THE INVENTION

It is an object of the present invention, which was completed in view of the foregoing, to provide a new intermediate transfer member and a new image-forming device provided therewith. The intermediate transfer member has a durable coating layer which easily conforms to the elastic deformation of the rubber layer, exhibits good wear resistance, permits easy resistance control, and fulfills such requirements as protection of the photosensitive body from staining, prevention of toner sticking, and decrease in the coefficient of friction.

To achieve the above-mentioned object, the present inventors carried out a series of researches which led to the finding that the intermediate transfer member which is disposed between an image forming body and a recording medium such that toner images formed on the surface of the image forming body are transferred to it and temporarily held on it and the transferred images are further transferred to a recording medium, will be satisfactory if it is made up of an electrically conductive rubber layer and a coating layer formed thereon, said coating layer being composed mainly of a urethane resin which is formed from a polyol compound and a polyisocyanate compound in an excess amount in terms of NCO/OH molar ratio and which contains a solvent-insoluble fraction no less than 70%, and that the coating layer thus specified easily conforms to the elastic deformation of the electrically conductive rubber layer without causing cracking, protects the photosensitive body from staining, prevents the toner from sticking to it, decreases the coefficient of friction, and ensures the formation of good images over a long period of time. The present invention is based on this finding.

The first aspect of the present invention resides in an intermediate transfer member of the type which is disposed between an image forming body and a recording medium such that toner images formed on the surface of the image forming body are transferred to it and temporarily held on it and the transferred images are further transferred to a recording medium, wherein said intermediate transfer member comprises an electrically conductive rubber layer and a coating layer formed thereon, said coating layer being composed mainly of a urethane resin which is formed from a polyol compound and a polyisocyanate compound in an excess amount in terms of NCO/OH molar ratio and which contains a solvent-insoluble fraction no less than 70%.

The second aspect of the present invention resides in an image-forming device of the type in which toner images formed on the surface of the image forming body are transferred to an intermediate transfer member and temporarily held on it and the transferred images are further transferred to a recording medium on which visible images are formed, wherein said intermediate transfer member is one which is defined as above. Incidentally, the solvent-insoluble fraction of the urethane resin is calculated from the equation below, Solvent-insoluble fraction (%)=(B/A)×100 where A denotes the weight of the urethane resin in the coating layer measured before immersion in a solvent, and B denotes the weight of the residual urethane resin in the coating layer measured after immersion in a solvent at 25° C. for 24 hours.

DESCRIPTION OF THE INVENTION

A detailed description of the present invention follows.

Figure 3:
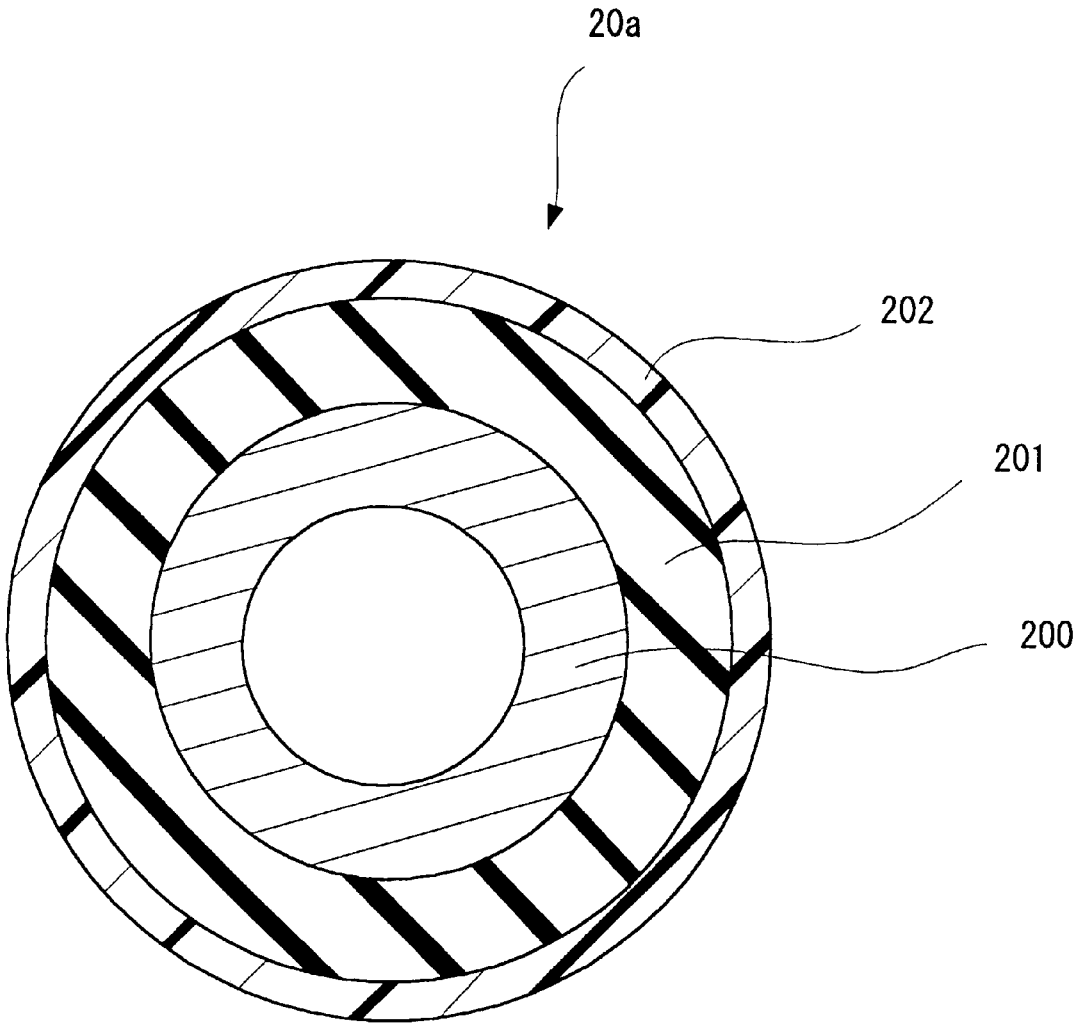
FIG. 3 is a schematic sectional view showing an example of the cylindrical intermediate transfer member pertaining to the present invention.
Figure 4:
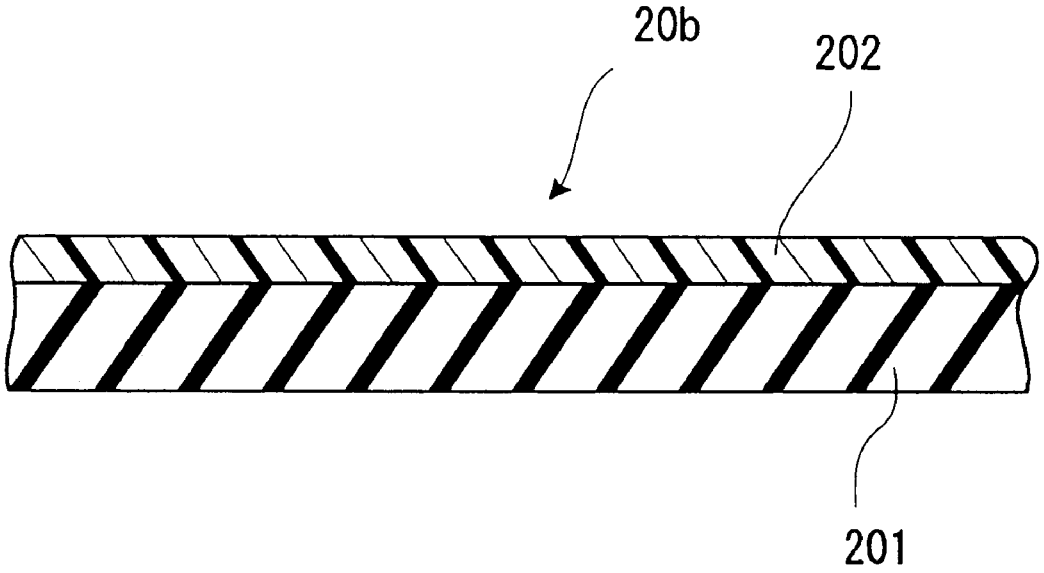
FIG. 4 is a schematic partial sectional view showing an example of the belt-like intermediate transfer member pertaining to the present invention.

According to the present invention, the intermediate transfer member is composed of an electrically conductive rubber layer 201 and a coating layer 202 formed thereon, as shown in FIGS. 3 and 4. The coating layer 202 is composed mainly of a urethane resin which is formed from a polyol compound and a polyisocyanate compound in an excess amount and which contains a solvent-insoluble fraction no less than 70%.

The electrically conductive rubber layer 201 is not specifically restricted; it may be formed from any rubber material which is rendered electrically conductive by incorporation with an electrically conducting material. Typical examples of the rubber material include nitrite rubber (NBR), ethylene-propylene rubber (EPDM), styrene-butadiene rubber (SBR), butadiene rubber (BR), isoprene rubber (IR), natural rubber (NR), silicone rubber, urethane rubber, acrylic rubber (ACR), chloroprene rubber (CR), butyl rubber (IIR), and epichlorohydrin rubber (ECO). They may be used alone or in combination with one another. Preferable among them are NBR, urethane rubber, ACR, ECO, EPDM, and a mixture of them or a mixture of them and any other rubber. They are desirable because of their good ozone resistance and good adhesion to the urethane resin constituting the coating layer 202.

The electrically conductive rubber layer 201 is incorporated with an electrically conducting material to impart or adjust electrical conductivity. The electrically conductive material may be divided into ionic ones and electronic ones. Examples of ionic electrically conducting materials include salts of tetraethylammonium, tetrabutylammonium, lauryltrimethylammonium, stearyltrimethylammonium, octadecyltrimethylammonium, dodecyltrimethylammonium, hexadecyltrimethylammonium, benzyltrimethylammonium, and dimethylethylammonium salt of modified fatty acid (as perchlorate, chlorate, hydrochloride, hydrobromide, hydroiodide, hydroborofluoride, sulfate, alkylsulfate, carbonate, sulfonate, etc.); and salts of alkali metal or alkaline earth metal, such as Li, Na, Ca, and Mg, (as perchlorate, chlorate, hydrochloride, hydrobromide, hydroiodide, hydroborofluoride, trifluoromethylsulfate, sulfonate, etc.).

Examples of electronic electrically conducting materials include electrically conductive carbon blacks, such as ketjen black and acetylene black; rubber carbon blacks, such as Super Abrasion Furnace (SAF), Intermediate Super Abrasion Furnace (ISAF), High Abrasion Furnace (HAF), Fast Extrusion Furnace (FEF), General Purpose Furnace (GPF), Super Processing Furnace (SRF), Fine Thermal (FT), and Medium Thermal (MT); acid-treated ink carbons, thermally decomposed carbon, and graphite; electrically conductive metal oxides such as tin oxide, titanium oxide, and zinc oxide; and metals such as nickel and copper.

These electrically conducting materials are not specifically restricted in their loading. The typical loading of ionic electrically conducting materials is 0.01 to 5 parts by weight, preferably 0.05 to 2 parts by weight, for 100 parts by weight of the rubber component. The typical loading of electronic electrically conducting materials is 1 to 50 parts by weight, preferably 5 to 40 parts by weight, for 100 parts by weight of the rubber component. An adequate loading should be selected so that the elastic layer 201 has a resistivity of $10^3$ to $10^{10}$ Ω·cm, preferably $10^4$ to $10^8$ Ω·cm.

Incidentally, the elastic layer 201 may be incorporated with, in addition to the above-mentioned electrically conducting materials, any known filler and crosslinking agent and rubber additives as much as necessary.

In the cylindrical intermediate transfer member as shown in FIG. 3, the electrically conductive rubber layer 201 is normally formed on the peripheral surface of a cylindrical base 200 made of plastics, aluminum, ferroalloy, copper alloy, or any other suitable material. In the belt-like intermediate transfer member as shown in FIG. 4, the electrically conductive rubber layer 201 in itself forms the belt, and it may be provided with a reinforcing layer laminated thereon or embedded therein.

The reinforcing layer may be made from resin and/or fiber. This resin may be any of known thermoplastic resins, thermosetting resins, and thermoplastic elastomers. Its examples include polycarbonate resin, polyester resin, polyamide resin, polyimide resin, polyurethane resin, polyether resin, polyvinyl resin, polyvinylidene resin, polyether ether ketone resin, and polysulfone resin. More than one reinforcing layer may be formed on top of the other, or the resinous reinforcing layer may be combined with the fibrous reinforcing layer mentioned later. The electrically conductive rubber layer 201 may be reinforced either by forming a resin layer thereon or by laminating a previously formed resin film thereon.

The fibrous reinforcing layer may be any known woven cloth or nonwoven cloth of natural fiber such as flax, wool, silk, and cotton, regenerated fiber such as viscose, synthetic fiber such as polyester, nylon (nylon 6, nylon 66, nylon 46, etc.), vinylon, vinylidene chloride, polyolefin (polyethylene, polypropylene, etc.), and polyclerk, semi-synthetic fiber such as acetate, so-called high-function fiber such as aramid fiber, polyvinyl alcohol fiber, and polyacrylonitrile fiber, and metal fiber such as steel and stainless steel. The woven cloth may be of plain weave, twill weave, or satin weave, or a combination thereof. Plain weave is desirable because of its strength and economy.

The fibrous reinforcing layer may be a laminate composed of more than one layer of the above-mentioned woven cloth or nonwoven cloth. It is not specifically restricted in thickness. The layer thickness is usually 0.01 to 2 mm, preferably 0.05 to 0.5 mm. With a thickness smaller than 0.01 mm, the fibrous reinforcing layer will be poor in dimensional stability and hence subject to elongation and other deformation. On the other hand, with a thickness larger than 2 mm, the fibrous reinforcing layer will lessen the flexibility of the belt-like intermediate transfer member. The woven cloth or nonwoven cloth for the fibrous reinforcing layer is not specifically restricted in fiber thickness. A desirable thickness is 20 to 420 denier, more desirably 30 to 210 denier, and most desirably 30 to 80 denier. The above-mentioned woven cloth or nonwoven cloth is not specifically restricted in thickness. A comparatively thin one is desirable. To be more specific, a thickness of 0.01 to 0.2 mm, particularly 0.05 to 0.15 mm, is desirable. With a thickness smaller than 0.01 mm, the fibrous reinforcing layer will be poor in dimensional stability and hence the intermediate transfer member will be subject to elongation and other deformation. Conversely, with a thickness in excess of 0.2 mm, the fibrous reinforcing layer will impair the flexibility of the intermediate transfer member.

The woven cloth or nonwoven cloth as the fibrous reinforcing layer may be impregnated as needed entirely or partly (in the surface) with rubber or resin so as to improve its surface smoothness and its adhesion to the electrically conductive rubber layer 201 or the coating layer 202 mentioned later. Preferred impregnants include, for example, rubber cement based on the same kind of rubber as exemplified in rubber components for the electrically conductive rubber layer, epoxy resin, and resorcinol-formaldehyde resin (RFL), and mixtures thereof. Impregnation with these impregnants may be readily achieved by coating or dipping.

The electrically conductive rubber layer 201 is not specifically restricted in thickness, and an adequate thickness is established according to the kind of rubber and the form of the intermediate transfer member. A thickness of 2 to 10 mm is desirable for the cylindrical member, and a thickness of 0.5 to 3 mm is desirable for the belt-like member. Incidentally, the electrically conductive rubber layer 201 may be made up of two or more layers. For example, the main body of the belt-like intermediate transfer member may consist of two electrically conductive rubber layers, with the fibrous reinforcing layer disposed between them.

The coating layer 202 formed on the electrically conductive rubber layer 201 is composed mainly of a urethane resin which is formed from a polyol compound and a polyisocyanate compound in an excess amount and which contains a solvent-insoluble fraction no less than 70%.

The polyol compound used in the present invention is a compound which has two or more hydroxyl groups in one molecule and which is commonly used as a raw material of polyurethane. It includes, for example, polyether polyol, polyester polyol, polycarbonate polyol, polyolefin polyol, hydrogenated polyolefin polyol, polymer polyol, and silicone polyol. These polyol compounds may be in the form of prepolymer with residual hydroxyl groups and extended chains by a polyisocyanate compound or resinous polymer with residual hydroxyl groups and extremely extended chains by a polyisocyanate compound. Polyester polyol and its prepolymer or polymer with residual hydroxyl groups are desirable because they give rise to a urethane resin superior in mechanical and electrical properties. Of these examples, a polymer having hydroxyl groups is desirable because it yields a urethane resin superior in mechanical properties such as high elongation and high strength. These properties are necessary for the coating layer to conform to the electrically conductive rubber layer and to be highly resistant to wear. An example of such polymers is one-component urethane resin paint of solvent drying type which contains hydroxyl groups. A hydrogenated polyolefin polyol is desirable because it provides good resistance to ozone and nitrogen oxide which are evolved in the electrophotographic device.

The polyisocyanate compound used in the present invention is one which is commonly used as a raw material for urethane resins. It is a compound having two or more isocyanate groups in one molecule. Its typical examples include tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate, xylylene diisocyanate (XDI), tetramethylxylylene diisocyanate (TMXDI), cyclohexane diisocyanate, lysine ester diisocyanate, lysine ester triisocyanate (LDI), undecane triisocyanate, hexamethylene triisocyanate, and triphenylmethane triisocyanate, and their polymers, derivatives, modified products, and hydrogenated products.

These aliphatic, alicyclic, and aromatic polyisocyanate compounds may be used alone or in combination with one another. Preferable among them are such aromatic polyisocyanate compounds such as tolylene diisocyanate, diphenylmethane diisocyanate, and their derivatives, which give rise to a urethane resin superior in mechanical and electrical properties. Also preferable among them are modified hexamethylene diisocyanate and modified isophorone diisocyanate, which give rise to a urethane resin superior in ozone resistance. Their modified products with isocyanurate, biuret, or adduct are desirable from the standpoint of heat resistance.

According to the present invention, the urethane resin is produced from the polyol compound and the polyisocyanate in an excess amount in terms of NCO/OH molar ratio. The molar ratio of NCO groups in the polyisocyanate compound to OH groups in the polyol compound should be 2.5 to 30, preferably 3 to 20. If the NCO/OH ratio is smaller than specified above, the resulting urethane resin will not have satisfactory mechanical and electrical properties. On the other hand, if the NCO/OH ratio is larger than specified above, the resulting urethane resin will be hard and poor in electrical properties. The hard urethane resin (hence stiff coating film) results from the polyisocyanate compound functioning as a filler. The poor electrical properties are due to complex substances formed by reaction between the polyisocyanate compound and water.

According to the present invention, the urethane resin is formed such that it has a solvent-insoluble fraction no less than 70%, preferably no less than 80%. If the solvent-insoluble fraction is less than 70%, the urethane resin is poor in mechanical durability and hence the coating film wears out due to friction with the toner, cleaning roller, cleaning blade, photosensitive body, and paper, and other members. The urethane resin with a high solvent-insoluble fraction can be obtained when a polyol compound is reacted with a polyisocyanate compound in an excess amount in terms of NCO/OH ratio.

The solvent-insoluble fraction as defined in the present invention is calculated from the equation below Solvent-insoluble fraction (%)=(B/A)×100 where A denotes the weight of the urethane resin in the coating layer and B denotes the weight of the residual urethane resin in the coating layer measured after immersion in a solvent at 25° C. for 24 hours.

The solvent used for dissolution is one which can extract uncured components from the urethane resin. Methyl ethyl ketone (MEK) is suitable for polyether-based or polyester-based urethane resins, and toluene is suitable for polyolefin-based urethane resins.

The urethane resin to form the coating layer 202 is not specifically restricted. A polyester-based one having a glass transition point of −20° C. to 20° C. is desirable. If this requirement does not meet, the object of the present invention would not be achieved.

With a glass transition point lower than −20° C., the polyester-based urethane resin forming the coating layer 202 has a low cohesive force of molecules at about 10 to 30° C. at which the intermediate transfer member works in the electrophotographic image-forming device such as copying machine, facsimile, and printer. The result is that the coating layer 202 is poor in elongation and strength and high in frictional resistance and hence liable to wear due to friction against the photosensitive body and toner. Conversely, with a glass transition point higher than 20° C., the polyester-based urethane resin forming the coating layer 202 is so stiff at the above-mentioned working temperature that it damages the photosensitive body or it does not conform to the elastic deformation of the electrically conductive rubber layer 201, which causes peeling or cracking. A urethane resin containing phthalic acid and/or isophthalic acid is particularly desirable because it has a glass transition point in the range of −20° C. to 20° C.

For the coating layer to have improved resistance to ozone and nitrogen oxide, the urethane resin may be incorporated with an oxide or hydroxide of a metal selected from aluminum, zinc, magnesium, and calcium (which are not specifically restricted).

In general, urethane resins are poor in resistance to ozone and nitrogen oxide; therefore, when used in an image-forming device, such as electrophotographic device, they degrade and deteriorate in mechanical and electrical properties on contact with ozone and nitrogen oxide which are evolved in the device. In order to improve urethane resins in resistance to ozone and nitrogen oxide, the present inventors carried out extensive studies which led to the finding that if the urethane resin forming the coating layer is incorporated with an oxide or hydroxide of a metal selected from aluminum, zinc, magnesium, and calcium, it exhibits good resistance to ozone and nitrogen oxide while conforming well to the elastic deformation of the electrically conductive rubber layer.

No explication has been made yet on the mechanism by which the above-mentioned metal oxide or hydroxide improves urethane resins in resistance to ozone and nitrogen oxide. It is presumed that the metal oxide or hydroxide neutralizes and absorbs organic acids and nitrogen oxide formed by ozone, thereby preventing urethane resins from degradation. Of the above-mentioned metal oxide or hydroxide, magnesium oxide is particularly desirable because it is most effective in improving durability.

The oxide or hydroxide of a metal selected from aluminum, zinc, magnesium, and calcium may be added in any amount which is not specifically restricted. An amount of 0.5 to 100 parts by weight, particularly 1 to 50 parts by weight, for 100 parts by weight of urethane resin is desirable. An amount less than 0.5 parts by weight is not enough for improvement in resistance to ozone. Conversely, an amount more than 100 parts by weight is detrimental to the physical properties such as strength of the coating layer.

The intermediate transfer member according to the present invention has, as a whole, an adequate middle range of resistivity $10^{11}$ to $10^{14}$ Ω·cm if the resistivity of the coating layer 202 is properly controlled. One way for the coating layer 202 to have a controlled resistivity (so that the intermediate transfer member has a middle range of resistivity) is to incorporate it with an electrically conducting material. According to the present invention, however, the object is achieved by forming the coating layer 202 from the above-mentioned urethane resin having a volume resistivity of $10^{13}$ to $10^{16}$ Ω·cm instead of incorporating the coating layer 202 with an electrically conducting material. In this way it is possible to easily make the intermediate transfer member to have the above-mentioned middle range of resistivity.

The coating layer 202 is usually tens of micrometers in thickness so that the intermediate transfer member has adequate stiffness and is produced economically. For the intermediate transfer member with such a thin coating layer to have a middle range of resistivity as mentioned above, it is necessary that the coating layer 202 have a resistivity of $10^{13}$ to $10^{16}$ Ω·cm which is determined by the resistivity of the electrically conductive rubber layer. In the case where a coating layer having a resistivity of $10^{13}$ to $10^{16}$ Ω·cm is to be formed from a resinous material, it is common practice to select a resin with high resistivity and reduce its resistivity by incorporation with carbon or the like. However, it is difficult to prepare a coating material containing an electrically conducting material uniformly dispersed therein and hence it is difficult to obtain a coating layer having a uniform resistance. According to the present invention, however, the urethane resin as a principal material of the coating layer 202 intrinsically has a volume resistivity of $10^{13}$ to $10^{16}$ Ω·cm, so that it is possible to form the coating layer 202 without incorporating the urethane resin with an electrically conducting material. In other words, it is possible to form the intermediate transfer member having a middle range of resistivity without requiring complex and difficult steps for preparing a coating material or forming a coating layer in which the electrically conducting material is uniformly dispersed.

There are many urethane resins which broadly range in resistivity. A polyester-based urethane resin, particularly the one containing phthalic acid and/or isophthalic acid, is desirable because it has a volume resistivity in the range of $10^{13}$ to $10^{16}$ Ω·cm, and hence it is used to attain the adequate resistivity as mentioned above. A polyolefin-based urethane resin or a hydrogenated polyolefin-based urethane resin is also desirable because it can be made to have a volume resistivity in the range of $10^{13}$ to $10^{16}$ Ω·cm if it is prepared from an adequately selected polyisocyanate compound.

The coating layer 202 of the urethane resin containing a metal oxide or hydroxide as mentioned above may be additionally incorporated with other materials to reduce the coefficient of friction or to reduce stickiness, to reduce surface energy, to control static build-up and static capacity, and to control electric resistance. They are resins or fine particles of resin or inorganic substance which function as a slip agent or a charge controlling agent. Examples of such resins include fluorocarbon resin, polyamide resin, polyester resin, alkyd resin, melamine resin, phenolic resin, epoxy resin, acrylic resin, acryl-silicone resin, acryl-urethane resin, silicone resin, amino resin, urea resin, chlorinated polyethylene, ethylene-vinyl acetate resin, ethylene-ethyl acrylate resin, and polyvinyl butyral resin. Examples of fine particles include those of fluorocarbon resin, silicone resin, molybdenum sulfide, and graphite.

According to a preferred embodiment of the present invention, the coating layer 202 is formed from an adequate urethane resin so that it has a desired resistivity without incorporation with an electrically conducting material. In some cases, however, it may be incorporated with an adequate amount of electrically conducting material, such as carbon, metal powder, metal oxide powder, and ionic conducting material. Their examples are the same as those which are used for the electrically conductive rubber layer 201 as mentioned above.

The coating layer 202 may be formed by any unrestricted method. A common desirable method consists of coating the electrically conductive rubber layer 201 with a solution or dispersion of the above-mentioned urethane resin and additives in a solvent by dipping, roll coating, knife coating, or spraying, followed by drying and curing at normal temperature or 50 to 170° C. A preferred solvent for this purpose is alcohol such as methanol, ethanol, isopropanol, and butanol, ketone such as acetone, methyl ethyl ketone, and cyclohexane, aromatic hydrocarbon such as toluene and xylene, aliphatic hydrocarbon such as hexane, alicyclic hydrocarbon such as cyclohexane, ester such as ethyl acetate, ether such as isopropyl ether and tetrahydrofuran, amide such as dimethylsulfoamide, halogenated hydrocarbon such as chloroform and dichloroethane, and a mixture thereof.

The coating layer 202 is usually 1 to 60 μm thick, particularly 5 to 50 μm thick, although not restricted specifically.

Figure 1:
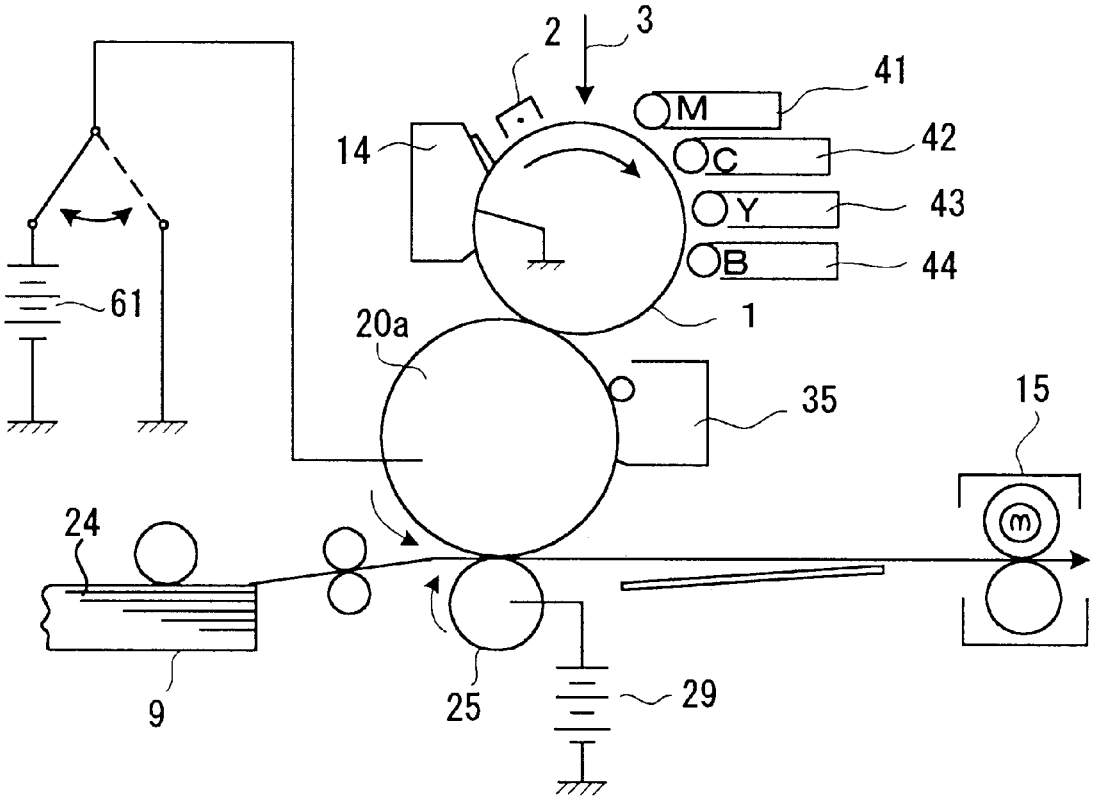
FIG. 1 is a schematic drawing showing an example of the image-forming device based on the intermediate transfer system.

The intermediate transfer member of the present invention is not limited to the cylindrical one or belt-like one as shown in FIGS. 3 and 4. It may take on any shape so long as it can be brought into contact with or proximity to the image-forming body such as photosensitive body in a stable manner. When it takes on a belt-like shape, the present invention produces its marked effect. In addition, the image-forming device that employs the intermediate transfer member of the present invention is not limited to the one shown in FIGS. 1 and 2. It may be modified in any way within the scope of the invention so long as it can be installed between the image forming body and the recording medium and it can temporarily hold thereon the toner image formed on the image forming body and then transfer it to the recording medium.

The intermediate transfer member of the present invention offers the advantage of giving good images continuously over a long period of time while preventing the photosensitive body from being stained and preventing the toner from sticking to it, owing to the coating layer of specific urethane resin which has a low coefficient of friction and conforms to the elastic deformation of electrically conductive layer underneath without cracking and peeling. The urethane resin forming the coating layer exhibits good resistance to ozone and nitrogen oxide when it is incorporated with a specific metal oxide or hydroxide mentioned above. Therefore, the coating layer has good durability and the image-forming device of the present invention which is equipped with the intermediate transfer member provides good images continuously over a long period of time.

EXAMPLES

The invention will be described in more detail with reference to the following examples and comparative examples, which are not intended to restrict the scope thereof.

Example 1

An endless rubber belt, 240 mm in width, 450 mm in circumference, and 1 mm in thickness, was prepared from a woven cloth wound around a mandrel and a rubber laminated thereon and subsequently vulcanized. This rubber is a mixture of nitrile rubber and ethylene-propylene rubber which contains carbon black in an amount for desired resistivity. The cured rubber of this rubber belt was found to have a hardness of 40 (JIS-A) and a volume resistivity of $1\times10^6$ Ω·cm.

The rubber belt was coated with a coating solution of the following composition.

Composition of coating solution:

| | |
|---|---|
| NIPPOLLAN 3124 (*1) | 25.0 g |
| CORONATE-L (*2) | 1.67 g |
| PTFE powder (*3) | 5.0 g |
| Methyl ethyl ketone (MEK) | 50.0 g |

(*1) Polyester polyol, 50 wt % solids, from Nippon Polyurethane Co., Ltd.
(*2) Polyisocyanate (modified tolylene diisocyanate), 75% solids, from Nippon Polyurethane Co., Ltd.
(*3) Powder of polytetrafluoroethylene, 0.3 μm in medial partical diameter, as an additive.

Coating was accomplished by spraying to give a coating layer about 30 μm thick, which was subsequently dried and cured at 140° C. for 30 minutes. The coated rubber belt was allowed to stand at 32.5° C. and 85% RH for 1 day. Thus there was obtained an intermediate transfer belt having a coating layer on the surface thereof.

The urethane resin forming the coating layer was found to have a solvent insoluble fraction of 84.6% and an NCO/OH molar ratio of 4.8. The solvent insoluble fraction is based on insoluble matter in methyl ethyl ketone. (The same shall apply hereinafter.)

Example 2

An intermediate transfer belt was prepared in the same manner as in Example 1, except that the composition of the coating solution was changed as follows.

Composition of coating solution:

| | |
|---|---|
| NIPPOLLAN 3124 | 25.0 g |
| CORONATE-L | 6.68 g |
| PTFE powder | 5.0 g |
| MEK | 50.0 g |

The urethane resin forming the coating layer was found to have a solvent insoluble fraction of 95.1% and an NCO/OH molar ratio of 19.2.

Example 3

An intermediate transfer belt was prepared in the same manner as in Example 1, except that the composition of the coating solution was changed as follows.

Composition of coating solution:

| | |
|---|---|
| NIPPOLLAN 3124 | 25.0 g |
| DURANATE 22A-75PX (*1) | 5.00 g |
| PTFE powder | 5.0 g |
| MEK | 50.0 g |

(*1) Polyisocyanate (modified hexamethylenediisocyanate), 75% solids, from Asahi Chemical Industry Co., Ltd.

The urethane resin forming the coating layer was found to have a solvent insoluble fraction of 91.2% and an NCO/OH molar ratio of 18.0.

Example 4

An intermediate transfer belt was prepared in the same manner as in Example 1, except that the composition of the coating solution was changed as follows.

Composition of coating solution:

Polyester-based urethane polymer

| | |
|---|---|
| SL-0866 (*1) | 25.0 g |
| CORONATE-L | 5.00 g |
| PTFE powder | 5.0 g |
| MEK | 50.0 g |

(*1) Polyol, 30% solids, from Sumitomo Bayer Urethane Co., Ltd.

The urethane resin forming the coating layer was found to have a solvent insoluble fraction of 94.5% and an NCO/OH molar ratio of 10.0.

| | |
|---|---|
| Potential of photosensitive body: | −550 V |
| Toner: | Non-magnetic one-component toner |
| Primary transfer voltage: | +500 V |
| Secondary transfer voltage: | +1500 V |
| Developing potential: | −400 V |
| Processing speed: | 126 mm/sec |

TABLE 1

| | Example 1 | Example 2 | Example 3 | Example 4 | Comparative Example 1 |
|---|---|---|---|---|---|
| Urethane resin | NIPPOLLAN 3124 | NIPPOLLAN 3124 | NIPPOLLAN 3124 | SL-0866 | NIPPOLLAN 3124 |
| Isocyanate | CORONATE-L | CORONATE-L | DURANATE 22A-75PX | CORONATE-L | CORONATE-L |
| NCO/OH molar ratio | 4.8 | 19.2 | 18.0 | 10.0 | 1.1 |
| Solvent insoluble fraction (%) | 84.6 | 95.1 | 91.2 | 94.5 | 20.3 |
| Resistivity of coating film (Ω.cm) | $4.0 \times 10^{14}$ | $1.6 \times 10^{15}$ | $2.5 \times 10^{14}$ | $1.6 \times 10^{14}$ | $1.6 \times 10^{14}$ |
| Resistivity of belt (Ω.cm) | $2.0 \times 10^{13}$ | $7.9 \times 10^{12}$ | $1.3 \times 10^{12}$ | $7.9 \times 10^{11}$ | $1.3 \times 10^{12}$ |
| Image test after 10000 runs of printing | Good transfer; no cracking | Good transfer; no cracking | Good transfer; no cracking | Good transfer; no cracking | Poor transfer; wearing |
| Staining of photosensitive body | No stain | No stain | No stain | No stain | No stain |

Comparative Example 1

An intermediate transfer belt was prepared in the same manner as in Example 1, except that the composition of the coating solution was changed as follows.

Composition of coating solution:

| | |
|---|---|
| NIPPOLLAN 3124 | 25.0 g |
| CORONATE-L | 0.38 g |
| PTFE powder | 5.0 g |
| MEK | 50.0 g |

The urethane resin forming the coating layer was found to have a solvent insoluble fraction of 20.3% and an NCO/OH molar ratio of 1.1.

The intermediate transfer belts obtained in the above-mentioned examples were tested as follows. The results are shown in Table 1.

Test for staining of photosensitive body

The photosensitive drum was pressed against the intermediate transfer belt for 3 weeks under a load of 500 g each applied to both ends. After separation, the surface of the photosensitive drum was examined for staining.

Test for images

Figure 2:
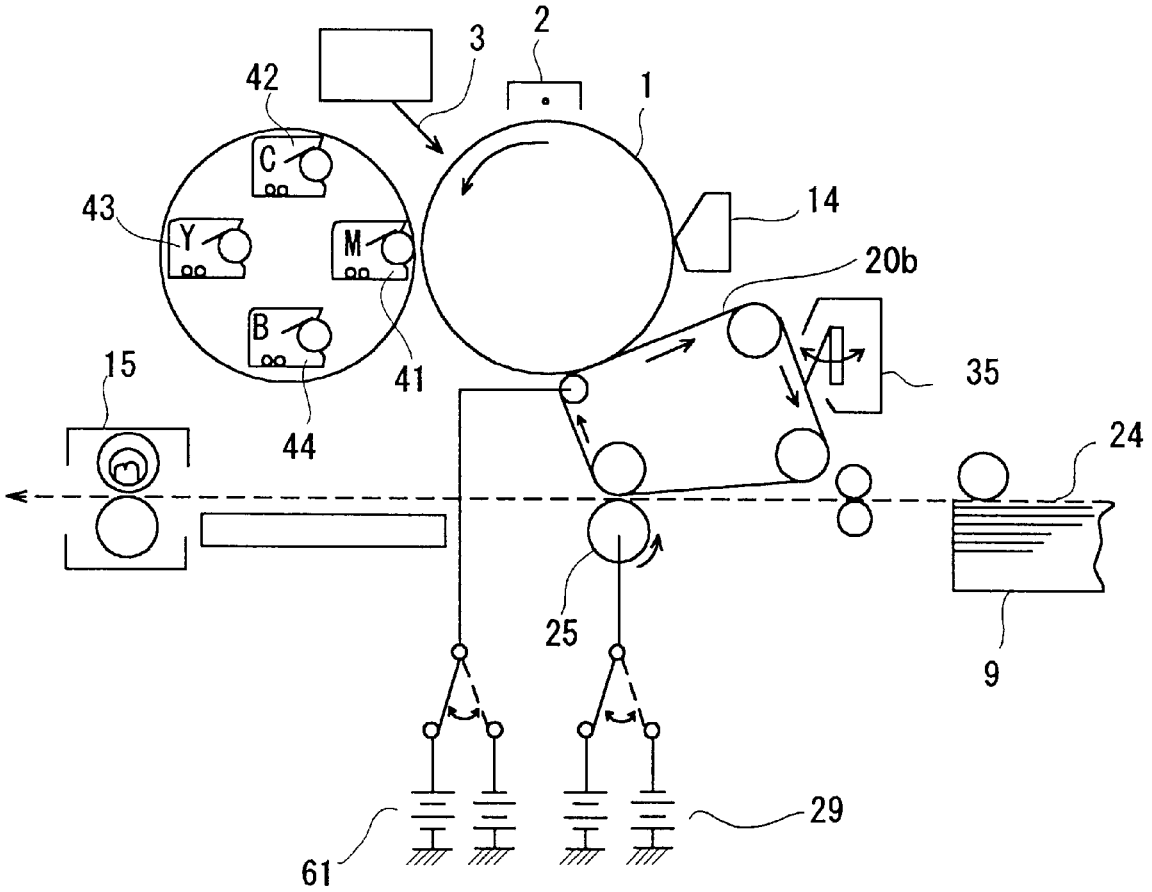
FIG. 2 is a schematic drawing showing another example of the image-forming device based on the intermediate transfer system.

The intermediate transfer belt was installed in a full-color printer of the same construction as the image-forming device shown in FIG. 2. The printer was run under the following conditions to make 10000 copies, and the resulting images were examined.

It is noted from Table 1 that the intermediate transfer belts in Examples 1 to 4 according to the present invention remained intact without cracking in the belt surface and kept their good transfer performance even after 10000 runs of printing, demonstrating their ability to produce good images over a long period of time. By contrast, it is noted that the intermediate transfer belt in Comparative Example, which is characterized by that the urethane resin forming the coating layer has a low solvent insoluble fraction, has a tacky surface and a high coefficient of friction, which lead to poor toner transfer.

Example 5

A coating solution of the following composition was prepared.

| | |
|---|---|
| NIPPOLLAN 3124 (*1) | 25.0 g |
| CORONATE-L (*2) | 5.0 g |
| Magnesium oxide (*3) | 1.25 g |
| PTFE powder (*4) | 5.0 g |
| Methyl ethyl ketone | 55.0 g |

(*1) Polyester polyol (solvent-dry type), 50 wt % solids, from Nippon Polyurethane Co., Ltd.
(*2) Aromatic polyisocyanate (modified tolylene diisocyanate), 75% solids, from Nippon Polyurethane Co., Ltd.
(*3) As an additive, 3.5 μm in average particle diameter, from Kamishima Kagaku Kogyo Co., Ltd.
(*4) Powder of polytetrafluoroethylene, 0.3 μm in medial partical diameter, as an additive.

The coating solution was applied by spraying to the same rubber belt as prepared in Example 1 to form a urethane resin coating layer about 40 μm thick thereon, which was dried and cured at 140° C. for 30 minutes. In this way there was obtained an intermediate transfer belt. The coating solution was also cast into a mold and cured therein at 140° C. for 30 minutes to give a sample of resin sheet. The urethane resin forming the coating layer was found to have a solvent-insoluble fraction of 90.3% and an NCO/OH molar ratio of 14.4.

Example 6

| | |
|---|---|
| NIPPOLLAN 3124 | 25.0 g |
| CORONATE-L | 5.0 g |
| Magnesium oxide | 6.25 g |
| PTFE powder | 5.0 g |
| Methyl ethyl ketone | 55.0 g |

This coating solution was processed in the same manner as in Example 5 to give an intermediate transfer belt and a resin sheet. The urethane resin forming the coating layer was found to have a solvent-insoluble fraction of 91.2% and an NCO/OH molar ratio of 14.4.

EXAMPLE 7

| | |
|---|---|
| NIPPOLLAN 3124 | 25.0 g |
| CORONATE-L | 5.0 g |
| Zinc oxide | 1.25 g |
| PTFE powder | 5.0 g |
| Methyl ethyl ketone | 55.0 g |

This coating solution was processed in the same manner as in Example 5 to give an intermediate transfer belt and a resin sheet. The urethane resin forming the coating layer was found to have a solvent-insoluble fraction of 92.4% and an NCO/OH molar ratio of 14.4.

Example 8

A coating solution of the following composition was prepared in the same manner as in Example 5, except that the magnesium oxide was replaced by aluminum hydroxide.

Composition of coating solution:

| | |
|---|---|
| NIPPOLLAN 3124 | 25.0 g |
| CORONATE-L | 5.0 g |
| Aluminum hydroxide | 6.25 g |
| PTFE powder | 5.0 g |
| Methyl ethyl ketone | 55.0 g |

This coating solution was processed in the same manner as in Example 5 to give an intermediate transfer belt and a resin sheet. The urethane resin forming the coating layer was found to have a solvent-insoluble fraction of 92.6% and an NCO/OH molar ratio of 14.4.

The intermediate transfer belts and resin sheets obtained in Examples 5 to 8 mentioned above underwent ozone exposure test (explained below) and image forming test as in Examples 1 to 4. The results are shown in Table 2. A resin sheet as control was prepared in the same manner as in Example 5 except that the coating solution contains no magnesium oxide, and it also underwent the ozone exposure test. The results are shown in Table 2.

Ozone exposure test

Resin sheet samples are allowed to stand in an atmosphere containing 10 ppm ozone in a chamber at 35° C. for 120 hours, and change in its volume resistivity before and after ozone exposure is calculated from the equation below.

Change (in orders of magnitude)=log {(the volume resistivity after test)/(the volume resistivity before test)}

TABLE 2

| | Example 5 | Example 6 | Example 7 | Example 8 | Control |
|---|---|---|---|---|---|
| Volume resistivity of resin sheet (Ω.cm) | $7.1 \times 10^{14}$ | $8.6 \times 10^{14}$ | $4.5 \times 10^{14}$ | $2.6 \times 10^{14}$ | $5.0 \times 10^{14}$ |
| Volume resistivity of resin sheet after ozone exposure test (Ω.cm) | $6.0 \times 10^{14}$ | $7.2 \times 10^{14}$ | $1.8 \times 10^{14}$ | $8.2 \times 10^{13}$ | $2.0 \times 10^{13}$ |
| Change in volume resistivity before and after ozone exposure test (orders of magnitude) | −0.07 | −0.08 | −0.4 | −0.5 | −1.4 |
| Initial image test | Good | Good | Good | Good | Good |
| Image test after 10000 runs of printing | Good | Good | Good | Good | — |

It is noted from Table 2 that the intermediate transfer belts in Examples 5 to 8 according to the present invention change in resistivity by less than 0.5 orders of magnitude after ozone exposure test. This suggests that they produce good images in a stable manner over a long period of time. They showed no sign of surface cracking and toner sticking even after 10000 runs of printing. By contrast, the coating layer (resin sheet) containing none of oxide or hydroxide of aluminum, zinc, magnesium, or calcium greatly changes in volume resistivity after ozone exposure.

What is claimed is:

1. An intermediate transfer member of the type which is disposed between an image forming body and a recording medium such that toner images formed on the surface of the image forming body are transferred to it and temporarily held on it and the transferred images are further transferred to a recording medium, wherein said intermediate transfer member comprises an electrically conductive rubber layer and a coating layer formed thereon, said coating layer being composed mainly of a urethane resin which is formed from a polyol compound and a polyisocyanate compound in an excess amount in terms of NCO/OH molar ratio and which contains a solvent-insoluble fraction no less than 70%.

2. An intermediate transfer member as defined in claim 1, wherein the molar ratio of NCO groups in the polyisocyanate compound to OH groups in the polyol compound is 2.5 to 30.

3. An intermediate transfer member as defined in claim 1, wherein the coating layer is composed of a urethane resin and an oxide or hydroxide of a metal selected from aluminum, zinc, magnesium, and calcium.

4. An intermediate transfer member as defined in claim 1, wherein the urethane resin is polyether- or polyester-based one and contains a solvent-insoluble fraction in methyl ethyl ketone no less than 70%.

5. An intermediate transfer member as defined in claim 1, wherein the urethane resin is polyolefin-based one and contains a solvent-insoluble fraction in toluene no less than 70%.

6. An intermediate transfer member as defined in claim 1, wherein the polyol compound is a polyester polyol, polyolefin polyol, prepolymer, or polymer.

7. An intermediate transfer member as defined in claim 1, wherein the polyisocyanate compound is one or more than one kind of aliphatic, alicyclic, and aromatic ones.

8. An intermediate transfer member as defined in claim 1, wherein the coating layer contains no electrically conducting material and has a volume resistivity in the range of $10^{13}$ to $10^{16}$ Ω·cm.

9. An intermediate transfer member as defined in claim 1, wherein the electrically conductive rubber layer is composed of any of nitrile rubber, urethane rubber, acrylic rubber, epichlorohydrin rubber, and ethylene propylene rubber, or a mixture of them or a mixture of them and another rubber.

10. An intermediate transfer member as defined in claim 1, wherein the electrically conductive rubber layer has a resistivity in the range of $10^{3}$ to $10^{10}$ Ω·cm.

11. An intermediate transfer member as defined in claim 1, which is in the form of belt.

12. An image-forming device of the type in which toner images formed on the image forming body are transferred to an intermediate transfer member and temporarily held on it and the transferred images are further transferred to a recording medium on which visible images are formed, wherein said intermediate transfer member is one which is defined in claim 1.

* * * * *